US009225050B2

(12) United States Patent
Yen et al.

(10) Patent No.: US 9,225,050 B2
(45) Date of Patent: Dec. 29, 2015

(54) WIDEBAND HIGH FREQUENCY BANDPASS FILTER

(71) Applicant: NATIONAL TSING HUA UNIVERSITY, Hsinchu (TW)

(72) Inventors: Ta-Jen Yen, Zhubei (TW); Ruei-Han Jiang, Taoyuan County (TW); Tsung-Yu Huang, Zhongli (TW); Ai-Ping Yen, Hsinchu County (TW)

(73) Assignee: NATIONAL TSING HUA UNIVERSITY, Hsinchu (TW)

( * ) Notice: Subject to any disclaimer, the term of this patent is extended or adjusted under 35 U.S.C. 154(b) by 418 days.

(21) Appl. No.: 13/842,763

(22) Filed: Mar. 15, 2013

(65) Prior Publication Data

US 2014/0191827 A1 Jul. 10, 2014

(30) Foreign Application Priority Data

Jan. 4, 2013 (TW) ..... 102100199 A

(51) Int. Cl.
*H01P 1/203* (2006.01)

(52) U.S. Cl.
CPC ..... *H01P 1/203* (2013.01); *H01P 1/20381* (2013.01)

(58) Field of Classification Search
CPC ..... H01P 1/203; H01P 1/201; H01P 1/20381
USPC ..... 333/204
See application file for complete search history.

(56) References Cited

U.S. PATENT DOCUMENTS

2007/0176727 A1* 8/2007 Chen et al. ..... 336/232
2012/0139666 A1* 6/2012 Yen et al. ..... 333/204

OTHER PUBLICATIONS

Hu et al., "Novel Compact Ultra- Wideband Filter With Wide Stop-Band", Microwave and Optical Technology Letters, vol. 51, No. 1, Jan. 2009,pp. 53-55.*

* cited by examiner

*Primary Examiner* — Stephen E Jones
(74) *Attorney, Agent, or Firm* — Muncy, Geissler, Olds & Lowe, P.C.

(57) ABSTRACT

A wideband high frequency bandpass filter is disclosed, which includes an open-circuit resonator structure and a short-circuit resonator structure. The open-circuit resonator has a signal transmission strip line and a T-shaped strip line. Both ends of the signal transmission strip line are bent toward to opposite ends of the T-shaped strip line respectively, so as to form gaps in the open-circuit resonator. The open-circuit resonator structure and the short-circuit resonator structure are coupled under the resonant mode, thereby achieving a bandpass filtering at 60 GHz.

9 Claims, 5 Drawing Sheets

WIDEBAND HIGH FREQUENCY BANDPASS FILTER

CROSS-REFERENCE TO RELATED APPLICATION

This application claims the benefit of Taiwan Patent Application No. 102100199, filed on Jan. 4, 2013, in the Taiwan Intellectual Property Office, the disclosure of which is incorporated herein in its entirety by reference.

BACKGROUND OF THE INVENTION

1. Field of the Invention

The present invention generally relates to a wideband high frequency bandpass filter, in particular to a wideband high frequency bandpass filter utilized to filter the electromagnetic wave having a central frequency of 60 GHz.

2. Description of the Related Art

The Federal Communication Commission of Unite States on 2011 established a standard that any wireless communication at the band near 60 GHz (i.e. 57-64 GHz) enjoys the right of using free band width, and thus international major communication companies such as LG, Panasonic, NEC, Samsung, Sony and Toshiba promote that high resolution videos without compression but with resolution up to 1920×1080 p can be wirelessly transmitted at the band of 60 GHz. In high frequency transmission, 60 GHz can thoroughly implement wireless communication and high speed transmission in our daily life.

Wherein, the filter can determine the frequency range of transmission signal, and thus designing a bandpass filter filtering the electromagnetic wave with a central frequency of 60 GHz becomes the researching emphasis in recent years.

It is worth to mention that bandpass filters have been already developed maturely in conventional Wi-Fi technology. Thus, the research and development personnel starts developing the bandpass filter applying on filtering the electromagnetic wave with a central frequency of 60 GHz based on the bandpass filter developed in Wi-Fi technology. However, the signal frequency which the bandpass filters developed in accordance with the broadly used Wi-Fi technology are able to handle fall within the range of a few GHz and hundreds of MHz. Consequently, the conventional designing standard of bandpass filter in Wi-Fi technology will be hard to achieve well performing bandpass filter having the central frequency of 60 GHz.

More specifically, the transmission distance is confined owing to the severe power absorption in the air of the 60 GHz signal. Thus, all the currently available 60 GHz bandpass filters can not achieve low loss, high conversion efficiency and broad stopband extension, and using the designing methology of the conventional bandpass filter will require more elements and leads to higher design complexity and higher cost.

SUMMARY OF THE INVENTION

In light of the issues raised in prior arts above, the primary objective of the present invention is to solve the problem that bandpass filter for Wi-Fi cannot be directly used in the wireless transmission at a high frequency band of 60 GHz.

To achieve the foregoing objective, the present invention provides a wideband high frequency bandpass filter, which is utilized to filter the electromagnetic wave having a central frequency of 60 GHz and which includes a short-circuit resonator structure and an open-circuit resonator structure. The short-circuit resonator structure comprises a first T-shaped strip line, and the first T-shaped strip line comprises a ground terminal, a first terminal and a second terminal opposite to the first terminal. The open-circuit resonator structure comprises a second T-shaped strip line and a signal transmission strip line, the second T-shaped strip line comprises a third terminal, a fourth terminal and a fifth terminal, the third terminal and the fourth terminal are opposite to each other, the fifth terminal is connected to the signal transmission strip line, and two opposite ends of the signal transmission strip line are bent toward to the third terminal and the fourth terminal respectively, so as to form a gap with the third terminal and the fourth terminal respectively. Wherein, the signal transmission strip line faces and aparts from a strip line segment between the first terminal and the second terminal with an interval, a signal input terminal and a signal output terminal are disposed on bent portions of the signal transmission strip line respectively, the signal input terminal receives an electromagnetic wave signal, and the signal output terminal outputs the filtered electromagnetic wave signal.

Preferably, the linewidth of the second T-shaped strip line may be greater than the linewidth of the signal transmission strip line.

Preferably, the length of the strip line between the first terminal and the second terminal may be greater than the length of the strip line between the third terminal and the fourth terminal.

Preferably, the bent portions of the signal transmission strip line may be an L-shaped segment.

Preferably, the interval may be approximately 60 μm.

Preferably, the signal input terminal and the signal output terminal may be disposed in the interval and near the bending parts of the signal transmission strip line respectively.

Preferably, the signal input terminal and the signal output terminal may be spaced with a 5 μm distance from the signal transmission strip line.

Preferably, the wideband high frequency bandpass filter may further comprise a substrate, and the surface of the substrate may be utilized to fixedly dispose the first T-shaped strip line of the short-circuit resonance structure, the second T-shaped strip line of the open-circuit resonance structure and the signal transmission strip line.

Preferably, the material of the substrate may be polyimide.

In summary, the present invention utilizes the combination of the open-circuit resonator structure having the right hand character and the short-circuit resonator structure having left-hand character to form the wideband bandpass filter, and reduces the energy loss and increases the energy conversion efficiency by designing the length, width and shapes of each of the strip line segments. Therefore, the present invention can achieve the purpose of wider passband, low loss and high conversion efficiency at the band of 60 GHz communication frequency.

DETAILED DESCRIPTION OF THE PREFERRED EMBODIMENTS

The technical content of the wideband high frequency bandpass filter of the present invention will become apparent by the description of the following embodiments with the accompanying drawings. In the following embodiments, the like reference symbols indicate the same or similar components.

To be explained herein, the wideband high frequency bandpass filter of the present invention is applied to filter the electromagnetic wave with a central frequency of 60 GHz with the bandwidth ranges from 57 GHz to 64 GHz, and is utilized the composite left/right-hand transmission line structure through the frequency resonance to filter the electromagnetic wave signal.

Figure 1:
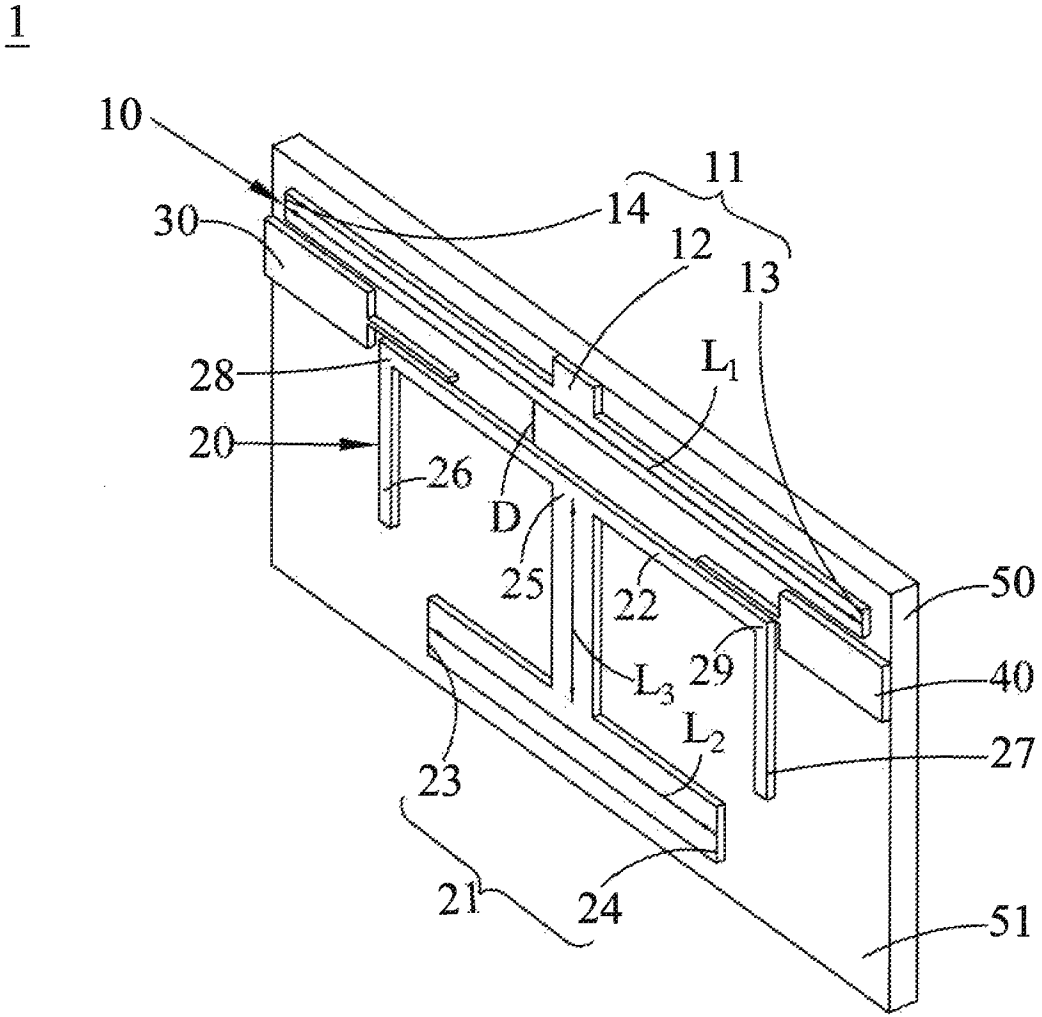
FIG. 1 is an illustration of a spatial structure of the wideband high frequency bandpass filter according to the first embodiment of the present invention.

With reference to FIG. 1 for an illustration of a spatial structure of the wideband high frequency bandpass filter according to the first embodiment of the present invention, the wideband high frequency bandpass filter 1 includes a short-circuit resonator structure 10 and an open-circuit resonator structure 20. The short-circuit resonator structure 10 has a first T-shaped strip line 11. The first T-shaped strip line 11 includes a ground terminal 12, a first terminal 13 and a second terminal 14 opposite to the first terminal 13. Besides, a strip line segment between the first terminal 13 and a second terminal 14 is approximately perpendicular to a strip line segment connected to ground terminal 12 and both of strip line segments are integrally formed. In other words, the strip line segment of the ground terminal 12 is perpendicularly extended from the strip line segment between the first terminal 13 and the second terminal 14.

The open resonator structure 20 has a second T-shaped strip line 21 and a signal transmission strip line 22. The second T-shaped strip line 21 includes a third terminal 23, a fourth terminal 24 and a fifth terminal 25. The fifth terminal 25 is connected to the signal transmission strip line 22. Wherein, two opposite ends 26 and 27 of the signal transmission strip line 22 are bent toward to the third terminal 23 and the fourth terminal 24 respectively, so as to form a gap with the third terminal 23 and the fourth terminal 24 respectively.

To be explained herein, the bent portions 28 and 29 of the signal transmission strip line 22 are presented as an L-shaped segment. That is, the bent portions 28 and 29 of the present embodiment are perpendicularly presented, but are not limited thereto. In other embodiments of the present invention, the bent portions 28 and 29 can be bent as a way of approximately L-shaped segment, which means that the bent portions 28 and 29 can be bent substantially as a curved shape.

The signal transmission strip line 22 faces to the strip line segment $L_1$ between the first terminal 13 and the second terminal 14 and aparts from the strip line segment $L_1$ an interval D. In the present embodiment, the interval D is about 60 μm, but is not limited thereto. In the other embodiment of the present invention, the interval D may range between 50 μm and 70 μm.

A signal input terminal 30 and a signal output terminal 40 are disposed near the bent portions 28 and 29 of the signal transmission strip line 22, wherein the signal input terminal 30 receives electromagnetic wave signal and the signal output terminal 40 outputs the filtered electromagnetic wave signal. More specifically, the signal input terminal 30 and the signal output terminal 40 are disposed in the interval D and near the bent portions 28 and 29 of the signal transmission strip line 22. The signal input terminal 30 and the signal output terminal 40 of the present embodiment are spaced from the bent portions 28 and 29 of the signal transmission strip line 22 at a distance of 5 μm, and spaced from the open-circuit resonance structure 20 at a distance of 45 μm.

In the present embodiment, the linewidth of the second T-shaped strip line 21 is greater than the linewidth of the signal transmission strip line. The length of the strip line segment $L_1$ between the first terminal 13 and the second terminal 14 and the length of the signal transmission strip line 22 are greater than the length of the strip line segment $L_2$ between the third terminal 23 and the fourth terminal 24. Furthermore, the wideband high frequency bandpass filter 1 of the present embodiment is disposed as a symmetric structure by the central of the strip line segment $L_3$ connected to the fifth terminal 25. As a result, through the configuration of length and linewidth described above, the wideband high frequency bandpass filter 1 of the present embodiment can effectively achieve the purpose of reducing the energy loss.

It is worthy to mention that the first T-shaped strip line 11 of the short-circuit resonator structure, the second T-shaped strip line 21 of the open-circuit resonator structure 20, the signal transmission strip line 22, the signal input terminal 30 and the signal output terminal 40 are fixedly disposed on the surface 51 of the substrate 50. In the present embodiment, the substrate 50 can be a flexible material such as the polyimide, but is not limited thereto. In the other embodiment of the present invention, the material of the substrate 50 can be a ceramic substrate made of aluminum oxide. Besides, the first T-shaped strip line 11 of the short-circuit resonator structure 10, the second T-shaped strip line 21 of the open-circuit resonator structure 20, the signal transmission strip line 22, the signal input terminal 30 and the signal output terminal 40 may be made of copper, but is not limited thereto.

As a result, all the elements of the present invention can be laid on the substrate 50, which can be adapted to common printed circuit boards, so as to integrate with other communication elements to form an SOC (System on Chip).

Figure 2:
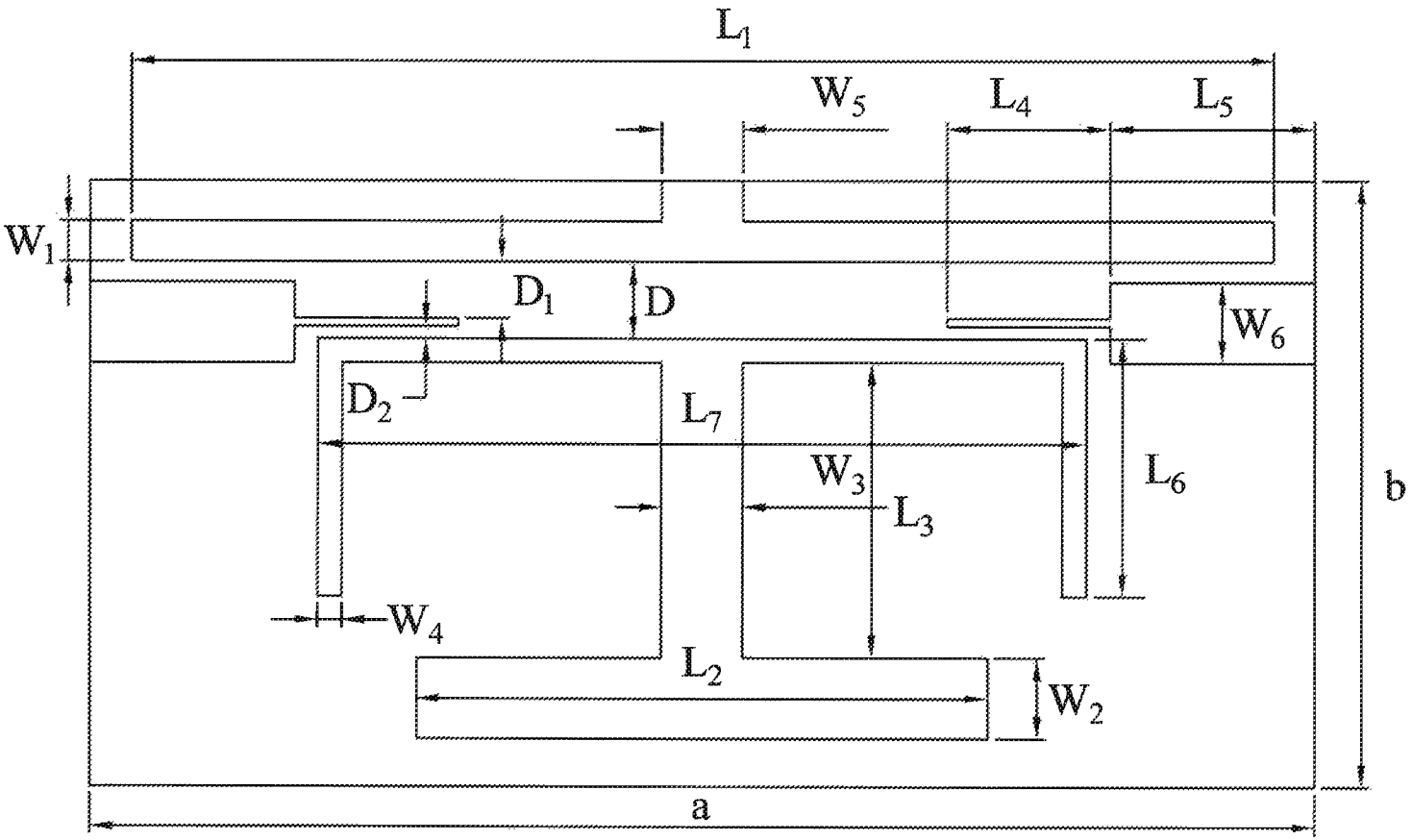
FIG. 2 is a schematic view showing the plane dimension of the first embodiment of the wideband high frequency bandpass filter of the present invention.

Referring to FIG. 1 now alone with FIG. 2 and Table 1, where FIG. 2 is a schematic view showing the plane dimension of the first embodiment of the wideband high frequency bandpass filter of the present invention and Table 1 is a detailed specification and distance of a wideband high frequency bandpass filter according to the first embodiment. Wherein, the material of the substrate of the present embodiment is made of polyimide whose dielectric constant $\in_r$ is 3.5 F/M, thickness is 30 mm, and the dimension of the substrate is 1.6×0.77 $mm^2$.

TABLE 1

| Parameter | Value (mm) | Parameter | Value (mm) |
|---|---|---|---|
| A | 1.6 | D | 0.06 |
| B | 0.77 | D1 | 0.045 |
| $L_1$ | 1.375 | D2 | 0.005 |
| $L_2$ | 0.085 | W1 | 0.02 |
| $L_3$ | 0.21 | W2 | 0.075 |
| $L_4$ | 0.18 | W3 | 0.075 |
| $L_5$ | 0.335 | W4 | 0.03 |
| $L_6$ | 0.206 | W5 | 0.09 |
| $L_7$ | 0.93 | W6 | 0.067 |

Wherein, the parameter a is the length of the substrate, the parameter b is the width of the substrate 50, the parameters $L_1$ to $L_7$ is the length of the strip line segments, the parameters D, $D_1$ and $D_2$ is the interval between the strip line segments, parameters $W_1$ to $W_6$ are the width of the strip line segments.

Figure 3:
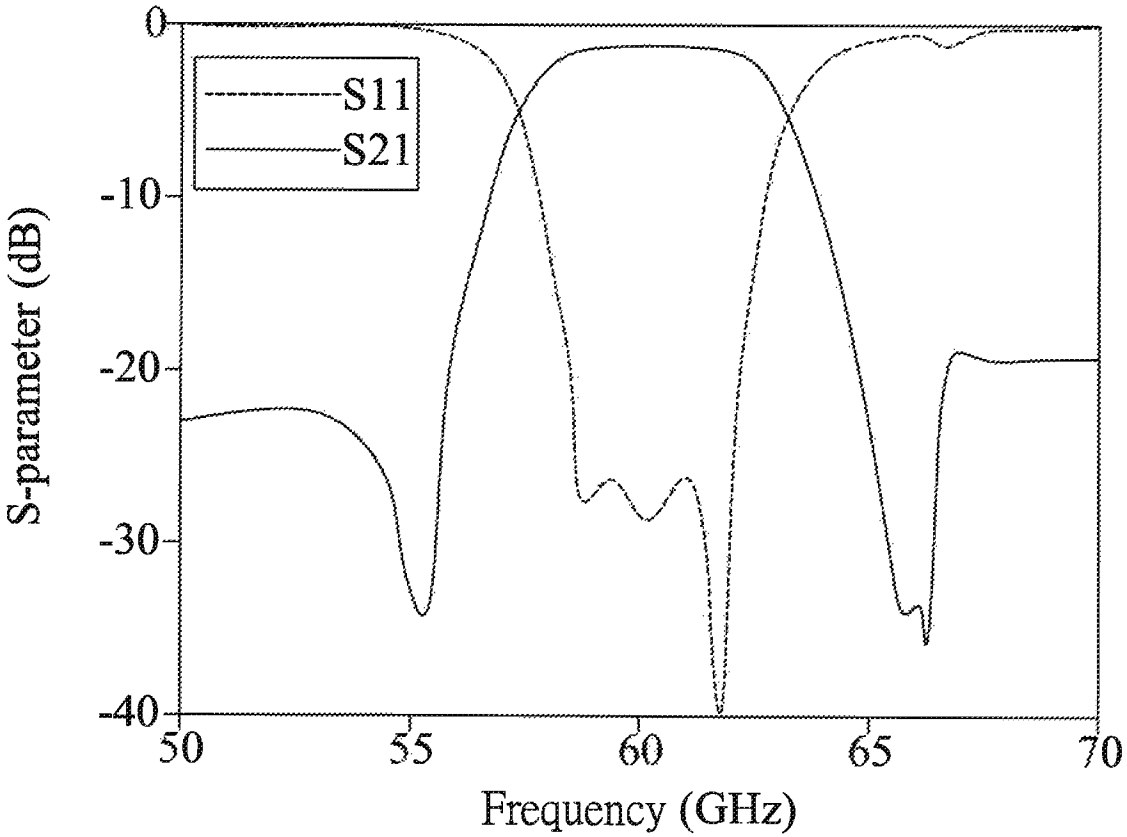
FIG. 3 is the simulation result of a narrowband of S parameter according to an embodiment of the present invention.

Referring now to Table 1, and FIG. 3, where FIG. 3 shows the simulation result of a narrowband of S parameters according to an embodiment of the present invention. As illustrated, from the curve $S_{21}$, the frequencies of −2 dB respectively fall at 57 GHz and 64 GHz, which are consistent with 57 GHz and 64 GHz of the common used band of 60 GHz. From curve $S_{11}$, the value is lower in the range of 57 GHz to 64 GHz and thus has better impedance match. Besides, the stop bands of the wideband high frequency bandpass filter of the present embodiment are respectively extended downward from 54 GHz to the DC current and extended upward from 64 GHz to 122 GHz. Therefore, the bandpass filter of the present embodiment has good wave filtered effectiveness. More specifically, by coupling under the resonant mode of the open-circuit resonator structure 20 and short-circuit resonator structure 10, the wideband high frequency bandpass filter of the present embodiment can achieve the effects of filtering the central frequency of 60 GHz.

Figure 4:
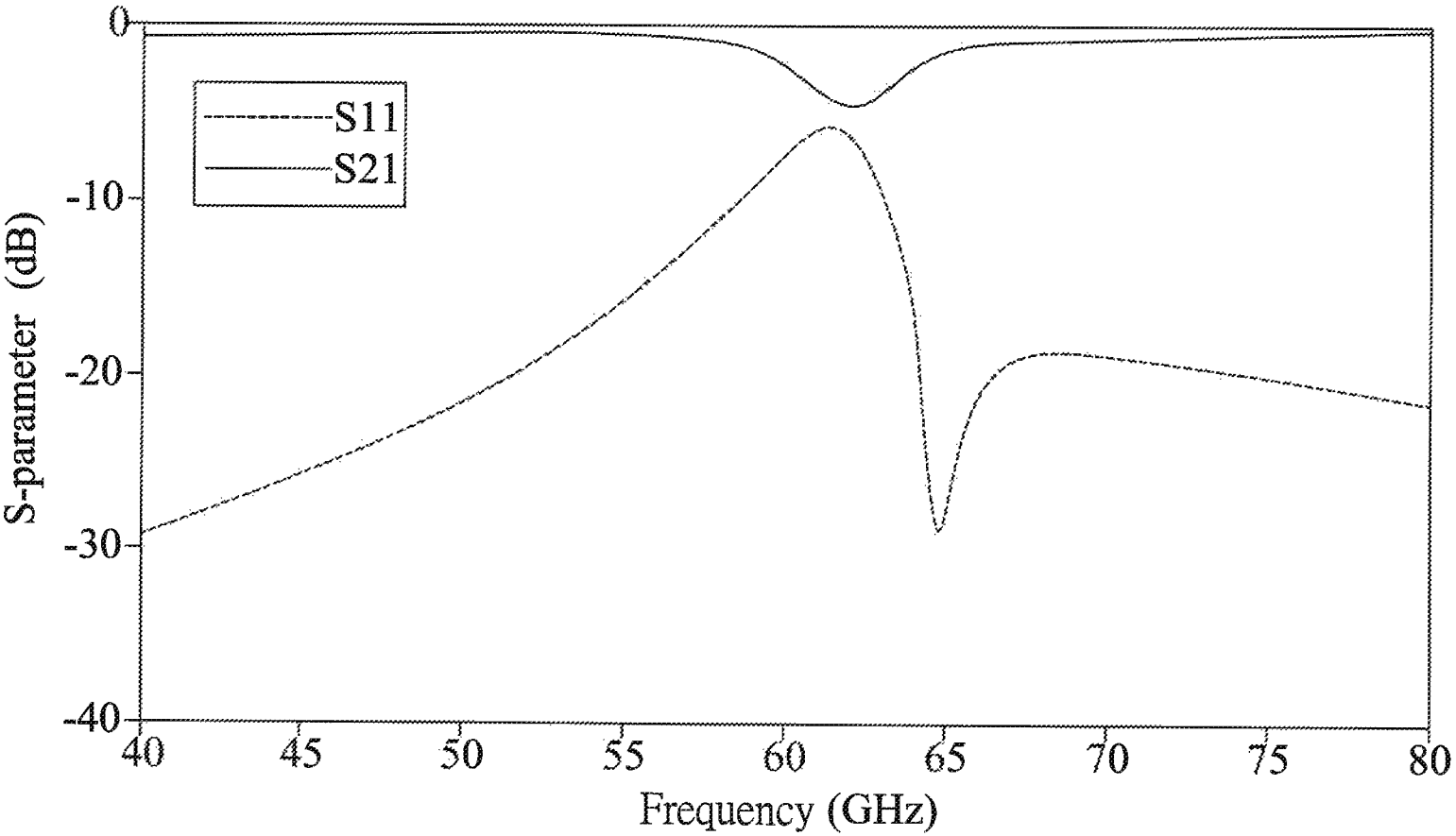
FIG. 4 is the simulation result of S parameter according to the open-circuit resonator structure of the present invention.
Figure 5:
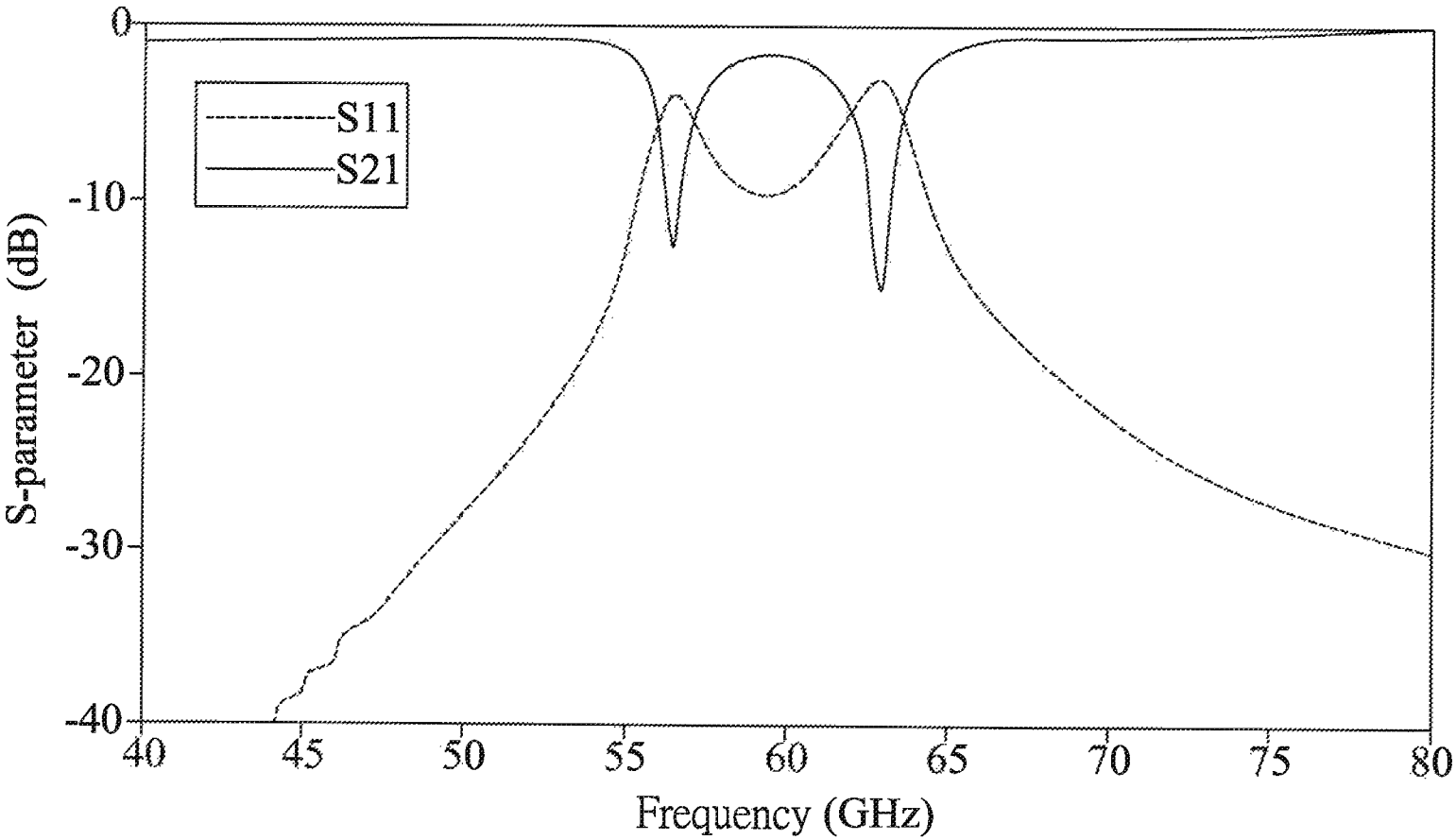
FIG. 5 is the simulation result of S parameter according to the short-circuit resonator structure of the present invention.

Referring to FIG. 4 and FIG. 5 for better understanding of the present invention, where FIG. 4 shows the simulation result of S parameter according to the open-circuit resonator structure of the present invention, and FIG. 5 shows the simulation result of S parameters according to the short-circuit resonator structure of the present invention. As illustrated, the open-circuit resonator structure 20 is mainly utilized to adjust the performance of the wideband high frequency bandpass filter of the present invention. Wherein, the open-circuit resonator structure 20 can couple the peak value in S parameter simulation result of the short-circuit resonator structure, so as to form the filter performance of the wideband high frequency bandpass filter in FIG. 3.

In summary, through the combination of the open-circuit resonator structure having right-hand character and the short-circuit resonator structure having left-hand character, the wideband high frequency bandpass filter can be further minimized, whose size can be minified into 1.28 $mm^2$, and can be applied to the 0603 industrial size standard. Meanwhile, the length, width and the shapes designing of each of the strip line segments of the present invention can effectively reduce the energy loss and increase the energy conversion efficiency, and thus achieve the purpose of wider passband and low loss at the band of 60 GHz. From the simulation results, it is known that the passband-stopband conversion efficiency of the present invention exceeds 10 dB/GHz, and the stopbands are respectively extended downward from 57 GHz to the DC current and extended upward from 64 GHz to 122 GHz. Therefore, the present invention can function as a high frequency bandpass filter for 60 GHz.

The embodiments described above are only to exemplify the present invention but not limit the scope of the present invention. Any equivalent modification or variation according to the spirit of the present invention is to be also included within the scope of the present invention.

What is claimed is:

1. A wideband high frequency bandpass filter, utilized to filter an electromagnetic wave having a central frequency of 60 GHz, comprising:

a short-circuit resonator structure comprising a first T-shaped strip line, and the first T-shaped strip line comprising a ground terminal, a first terminal and a second terminal opposite to the first terminal; and an open-circuit resonator structure comprising a second T-shaped strip line and a signal transmission strip line, the second T-shaped strip line comprising a third terminal, a fourth terminal and a fifth terminal, the third terminal and the fourth terminal being opposite to each other, the fifth terminal being connected to the signal transmission strip line, and two opposite ends of the signal transmission strip line being bent toward to the third terminal and the fourth terminal respectively, so as to form a gap with the third terminal and the fourth terminal respectively;

wherein, the signal transmission strip line faces and is aparts from a strip line segment between the first terminal and the second terminal with an interval, a signal input terminal and a signal output terminal are disposed near bent portions of the signal transmission strip line respectively, the signal input terminal receives an electromagnetic wave signal, and the signal output terminal outputs the filtered electromagnetic wave signal.

2. The wideband high frequency bandpass filter of claim 1, wherein the interval is approximately 60 μm.

3. The wideband high frequency bandpass filter of claim 1, wherein a linewidth of the second T-shaped strip line is greater than a linewidth of the signal transmission strip line.

4. The wideband high frequency bandpass filter of claim 3, wherein a length of the strip line between the first terminal and the second terminal is greater than a length of the strip line between the third terminal and the fourth terminal.

5. The wideband high frequency bandpass filter of claim 4, wherein the bent portions of the signal transmission strip line is an L-shaped segment.

6. The wideband high frequency bandpass filter of claim 1, wherein the signal input terminal and the signal output terminal are disposed in the interval and near the bending parts of the signal transmission strip line respectively.

7. The wideband high frequency bandpass filter of claim 6, wherein the signal input terminal and the signal output terminal are spaced with a 5 μm distance from the signal transmission strip line.

8. The wideband high frequency bandpass filter of claim 1, further comprising a substrate, and a surface of the substrate being utilized to fixedly dispose the first T-shaped strip line of the short-circuit resonance structure, the second T-shaped strip line of the open-circuit resonance structure and the signal transmission strip line.

9. The wideband high frequency bandpass filter of claim 8, wherein the material of the substrate is made of polyimide.

* * * * *